United States Patent [19]

Biran

[11] Patent Number: 4,813,709

[45] Date of Patent: Mar. 21, 1989

[54] PARKING CARDS

[76] Inventor: Adi Biran, 7 Egoz Street, Ramat Efal, Israel

[21] Appl. No.: 36,344

[22] Filed: Apr. 9, 1987

[51] Int. Cl.[4] ..... B42D 15/00; B42F 21/12

[52] U.S. Cl. ..... 283/23; 283/100

[58] Field of Search ..... 283/23, 25, 26, 27, 283/28, 29, 30, 33, 71, 72, 73, 103, 80, 100; 40/5, 333

[56] References Cited

U.S. PATENT DOCUMENTS

| | | | |
|---|---|---|---|
| 2,839,854 | 6/1958 | Martinet | 283/23 |
| 3,528,186 | 9/1970 | Roda | 283/23 |
| 3,966,232 | 6/1976 | Doriel | 283/23 |
| 4,240,649 | 12/1980 | Weber | 283/23 |
| 4,241,943 | 12/1980 | Malinovitz | 283/23 |

FOREIGN PATENT DOCUMENTS

| | | | |
|---|---|---|---|
| 964694 | 3/1975 | Canada | 283/23 |

*Primary Examiner*—Frank T. Yost
*Assistant Examiner*—Paul M. Heyrana, Sr.
*Attorney, Agent, or Firm*—Browdy and Neimark

[57] ABSTRACT

The invention relates to one-time use parking cards for cashless parking for a predetermined period of time. The card bears a number of parameters of day of the week, date of the month, a.m. or p.m., and a clock-face-like pattern of hours and clock-face-like pattern of a certain number of minutes each, each of the parameters on the card being provided witih a pattern of at least 3 cuts defining a closed geometrical shape, the uncut portions of said shape holding such area in place, such cuts making possible the easy tearing out of such area of the paper at the beginning of the parking period indicating the parking period.

8 Claims, 1 Drawing Sheet

The printing on the card

The cuts on the card

PARKING CARDS

FIELD OF THE INVENTION

The invention relates to a novel type of parking cards for cashless parking, which can be used for permitting parking of a motorcar for any predetermined period of time. The cards are easy to use and provide a clear indication to the user on the exact time of his parking period. The cards can be made from inexpensive paper and make cheating by the user very difficult.

BACKGROUND OF THE INVENTION

A number of parking card types is known which permit cashless parking. All of these are based on either the tearing-off or on the marking of certain indications of time, day, date etc., printed on the card, thus indicating the time of arrival and the time of expiration of the permitted parking period.

One of the types of known cards comprises a card made of cardboard with certain perforations defining precut tabs which can be torn off. This type is described in U.S. Pat. No. 3,966,232. Another card comprises a frangible surface layer which is destroyed by the user at the commencement of the parking period at certain areas of the cards.

There also exist parking permits which are issued by special devices into which the user inserts a certain sum of money at the beginning of the parking period, and which issues a receipt which indicates the permitted parking period, clearly indicating when the purchaser has to vacate the parking place. Such receipt is placed in the interior of the parked car so that it can be inspected from the outside.

Parking cards of various types have displaced to a large extent, the cumbersome mechanical parking meters into which coins have to be inserted and which are prone to mechanical failure and require expensive upkeep, and which are also prone to vandalism and to abuse by those who remove the coins.

SUMMARY OF THE INVENTION

The invention relates to a novel parking card which permits cashless parking for a predetermined period of time, according to the card used.

The novel cards have certain advantages over existing cards : instead of the cardboard used hitherto, paper can be used; the parking time parameters are easily marked; and the parking time parameters are easily discernible, avoiding possible mistakes.

The cards can be provided with a plurality of parameters indicating the exact parking time and making impossible the repeated use of a card.

The use of ordinary paper is made possible by the provision of a special type of perforation of the parts of the card to be torn off, making possible the positive indication of a certain value or other parameter such as day of the week, day of the month, hour of arrival, a.m. or p.m., and certain indications of sub-units of the hour.

Instead of precut sections of the parking cards described in U.S. Pat. No. 3,966,230, there are provided a sequence of cuts around a section of the paper which is to be torn off, such cuts defining for example, 3 or 4 sections of a circle, with small sections of the perimeter between such cuts. As will be illustrated in the following, the cuts comprise a part of the circumference of the circle which exceeds half of it, thus for example when we have a circle with 3 cuts, the cuts define each about 5°, while the continuous parts (3) of the circumference define about 115° each.

In practice, it has been found that circular removable parts of the parking card are convenient. It has been found that these are advantageously of a diameter of from 6 mm to about 8 mm; there being provided at least 2 and preferably 3 or 4 cuts, leaving between them one connection on about 2 mm, the other connections being of the order of about 0.5 mm to about 1 mm. each. Areas enclosed by cuts of different geometrical shape can be used as well.

BRIEF DESCRIPTION OF THE DRAWINGS

The invention is illustrated with reference to the enclosed schematical drawing, which is not according to scale and in which.

DETAILED DESCRIPTION OF THE PREFERRED EMBODIMENTS

Figure 1:
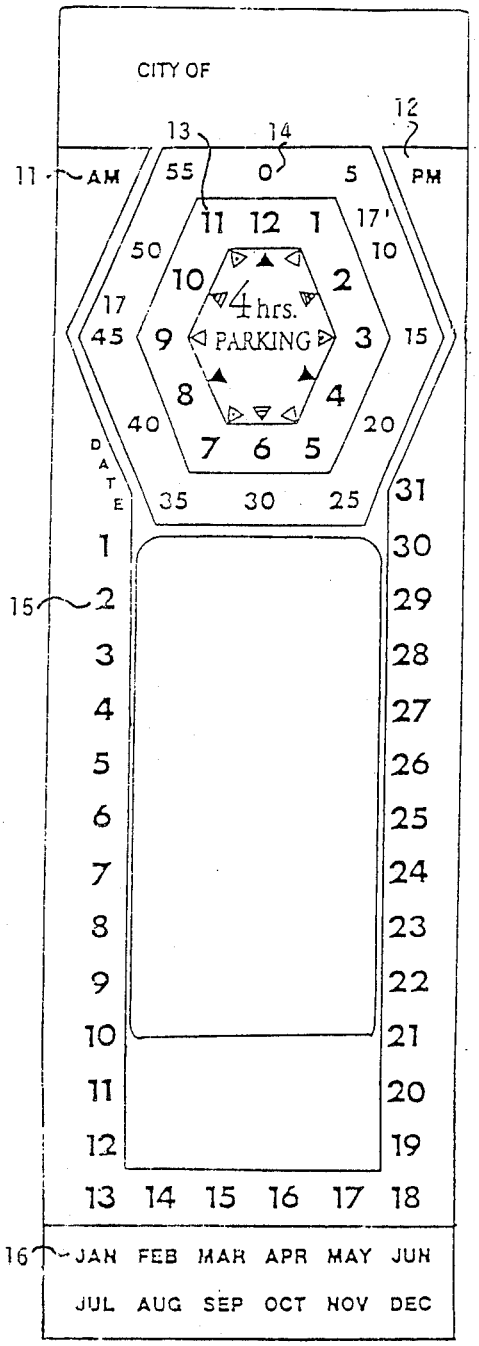
FIG. 1 is a front view of a 4-hour parking card of the invention.

As shown in FIG. 1, the card comprises indications for the following parameters: day of the month, month, hours (a.m. and p.m.), and 5-minute intervals; the hours and minute intervals being arranged in a clock-like pattern, either separately, or one inside the other, as in this specific case: resembling a clock.

When a driver arrives at the parking location, say at 9 a.m., on the 15th of the month, he tears off the "a.m." circle; he tears off the 9 hour circle, the date indication (15), and the zero-minute circle indicating the arrival at the exact hour, and also the month of the year. By providing all the parameters, the re-use of the card is practically avoided.

The clock-like hour and minute indication is easy to use and also provides an indication of the expiration of the parking period. In this card the circles are of 7 mm diameter, with two cuts leaving connections of 0.7 mm, while the third cut leaves a connection of about 2 mm.

Figure 2:
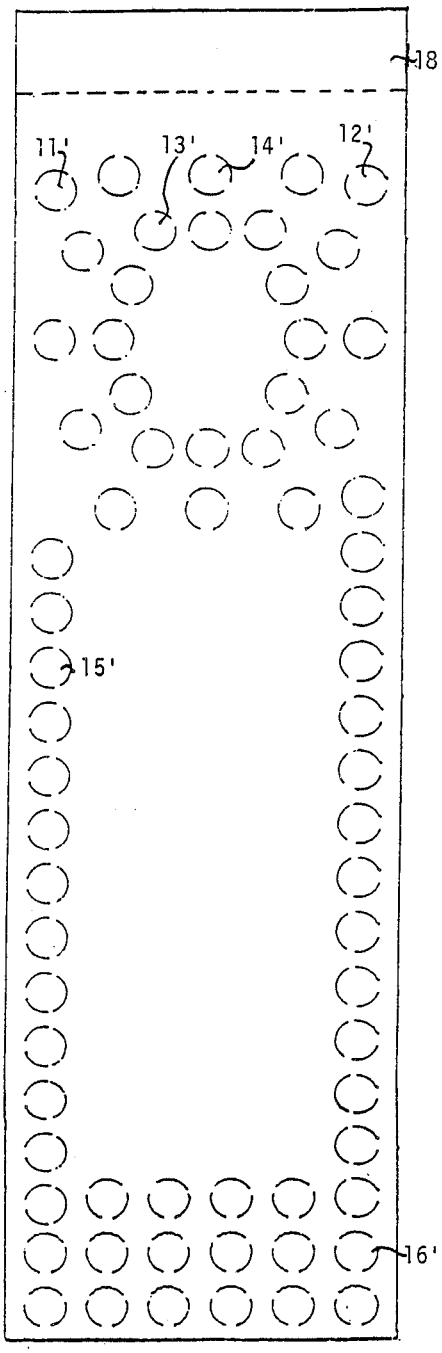
FIG. 2 is a front view of the same card indicating the cuts provided in the paper for an easy tearing-out of the required circular sections of the card, according to the pattern provided in FIG. 1.

The indications set out above are as follows: a.m. and p.m. indications 11 and 12 respectively with corresponding cut-outs 11' and 12'; hour indications from 1 to 12 indicated as 13; 5-minute intervals from 0 to 55 indicated as 14; date of the month 15, and month 16; the corresponding cuts being indicated in FIG. 2 as 13', 14', 15' and 16', respectively.

It is clear that there can be provided cards for any desired parking period, say from half an hour up to a number of hours; the only difference being the difference in printing required for such specific parking periods.

It is possible to use a certain color scheme or a certain pattern of recurring marks such as the triangles 17, where triangle 17 at the 9-hour mark is identical with that at 1 o'clock, 17', i.e. at the end of the 4-hour period.

It is clear that the above description is by way of illustration only and that variations and changes in the number of indicated parameters and in the arrangement of the data on the card can be resorted to without departing from the scope and spirit of the invention.

For example, it is clear that the precut sections can be in circular form as shown; there can also be used any other suitable geometric shape such as an ellipse, a polygon, etc. Due to the ease to retain the shape of the paper because of the precut, non-continuous sections, it is possible to use light-weight paper which constitutes a considerable economic advantage.

It is advantageous to provide an upper end portion 18 of the card which is bent over by the user and which is secured to the inside of the window of the car facing the sidewalk by opening a small opening of the window, inserting the card and closing it again, thus holding it in place by pressure on the bent-over section.

To provide means against counterfeit cards it is possible to provide on at least part of the card a visible or invisible print which can be detected by a laser-reader of the type used in reading labels in stores.

I claim:

1. A parking card for single-use cashless prepaid parking for a parking period comprising:

a plurality of means defining a parameter of the parking period;

a plurality of precut, easily removable sections defined by a number of cuts each, the cuts defining a closed geometrical shape; and said plurality of means defining a parameter comprising a clock-face-like pattern of hours and a clockwise pattern of a predetermined number of minutes each, a sequence of indications of the date of the month and an indication of a.m. and p.m., wherein each of the means defining a parameter corresponds to one of the plurality of precut sections.

2. A card according to claim 1, where hour and minute indications are provided on two concentrical clock-like patterns.

3. A card according to claim 1, where the minute pattern is subdivided into an interval selected from the group of 5, 10 or 15 minutes each.

4. A card according to claim 1, where said plurality of means for defining a parameters comprises parameters indicating day of the month, month of the year.

5. A card according to claim 4, where the day of the month and the month or day of the week are arranged in consecutive or interrupted columns, most of them along the edges of the card.

6. A card according to claim 1 where each of the means defining a parameter comprises a precut pattern formed by at least two cuts in a shape selected from the group of circular, elliptical and polygonal, the at least two cuts for allowing easy and complete removal of the precut pattern to indicate the parameters of the parking period.

7. A card according to claim 6, where the precut patterns are of circular shape having at least two curved cuts from about 5 mm to about 9 mm in length each.

8. A card claimed in claim 1, provided with an upper section which can be bent over and secured to the inside of the car-window by insertion and application of pressure by closing the window on such upper section.

* * * * *